United States Patent [19]

Cina et al.

[11] 4,074,744

[45] Feb. 21, 1978

[54] AUTOMATIC APPARATUS FOR PRODUCING MOLDS USING CHEMICALLY BONDED SANDS

[75] Inventors: Ronald A. Cina; Albert D. Kluge, both of Lansing, Mich.

[73] Assignee: Roberts Corporation, Lansing, Mich.

[21] Appl. No.: 763,813

[22] Filed: Jan. 31, 1977

[51] Int. Cl.[2] ..... B22C 15/28

[52] U.S. Cl. ..... 164/187; 164/195; 164/200

[58] Field of Search ..... 164/16, 38, 195, 401, 164/183, 187, 200

[56] References Cited

U.S. PATENT DOCUMENTS

| | | | |
|---|---|---|---|
| 3,384,151 | 5/1968 | Kerr et al. | 164/401 X |
| 3,556,195 | 1/1971 | Lund | 164/16 |
| 3,736,978 | 6/1973 | Taccone | 164/16 X |

*Primary Examiner*—Robert D. Baldwin
*Attorney, Agent, or Firm*—Miller, Morriss and Pappas

[57] ABSTRACT

An automatic method and apparatus for producing molds using chemically bonded sands which consists of a molding machine adapted to produce either honeycomb (horizontally parted) or controlled contour (vertically parted) mold elements. The molding machine is provided with a venturi-type blow head having dual blow valves and an integral air chamber. Carriage means are provided to selectively move a sand magazine and catalyst manifold between their respective fill and work stations on the molding machine. A hydraulically actuated mold receiver, trunnion rollover and shuttle car means are provided to selectively receive the completed molds from the molding machine and transport them to associated mold finishing and closing means. A hydraulically actuated pattern clamp table is provided with an enclosed pattern and stripper pin stool having a separate hydraulically actuated stripper pin plate. The enclosed pattern and stripper pin stool is an integral catalyst exhaust manifold. A mold squeeze method and apparatus is provided to selectively permit compression of the sand mold prior to the gassing of the chemically bonded sand mold.

5 Claims, 15 Drawing Figures

FIG. 12
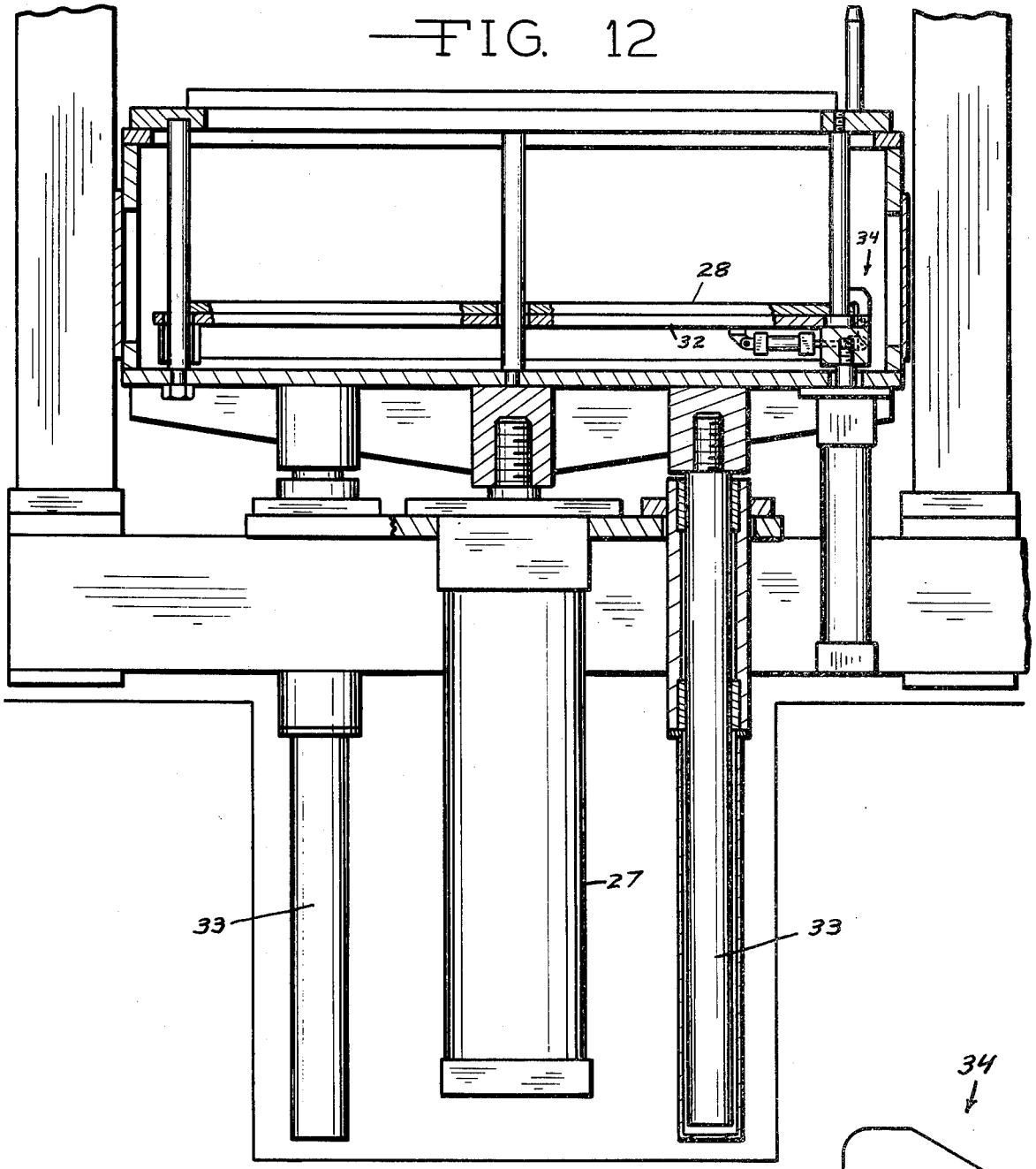
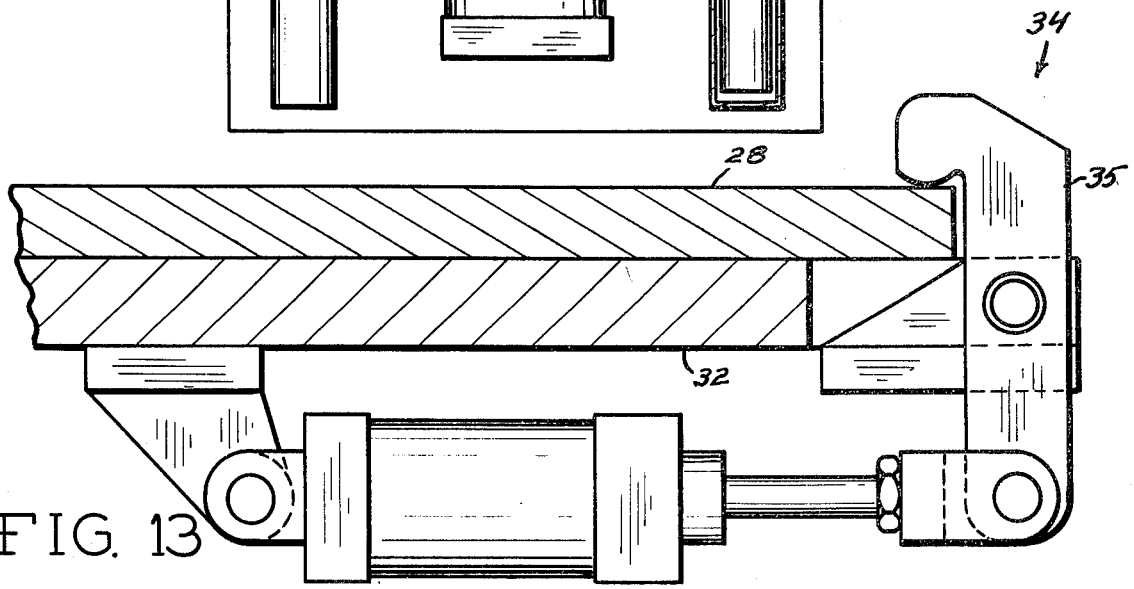
FIG. 13

AUTOMATIC APPARATUS FOR PRODUCING MOLDS USING CHEMICALLY BONDED SANDS

SUMMARY OF THE INVENTION

This invention relates to an automatic apparatus for producing molds using chemically bonded sands of the external catalyst type. The automatic method and apparatus of this invention is adapted to produce either horizontally parted honeycomb or vertically parted controlled contour molds. A venturi-type blow head or chamber is provided having dual blow valves and an integral chamber in association therewith. A bulk sand loading hopper is provided at the top of the molding machine so as to selectively deliver sand to the blow head assembly. A gas catalyst manifold head assembly is provided proximate to the sand blow head. A carriage assembly is provided whereby a sand magazine or gas catalyst manifold are selectively moved to and from their respective loading and work stations.

A hydraulically operated clamp table is provided for vertical movement and clamping of the pattern tooling stack. An enclosed pattern and stripper pin stool is provided on the clamp table. The enclosure comprises an integral exhaust manifold assembly to vent gases therefrom. A separate hydraulically controlled stripper pin actuator plate is provided in association with the enclosed pattern and stripper pin stool.

For horizontally parted honeycomb mold sections a hydraulically actuated mold receiver, rollover and shuttle car assembly is provided to clampably engage the blown cured mold and shuttle it to an ejection station. A trunnion rollover assembly is provided at the ejection station to invert the cured honeycomb mold. Automatic blown-off and selectively controllable release agent spray means are provided to blow-off and spray the pattern, flask and minimizer blow head. The cured mold is then engaged by a vertically movable ejector table or conveyor means as desired.

For vertically parted controlled contour molds a hydraulically actuated mold receiver, with integral adjustable extractor fingers, is provided to engage the cured mold and shuttle it to a removal station.

Automatic selectable blow-off and release agent spray means are provided to blow-off and spray the pattern and controlled contour blow head. The cured mold is then removed via automatic or manual means.

In one embodiment of the invention, a squeeze apparatus is provided whereby the sand mold is squeezed or compressed after blowing and prior to curing by the gas catalyst.

The squeeze or compression step achieves greater densification of the blown sand mass and permits for a lower percentage of resin and catalyst, in the sand mix, to arrive at high tensile strengths in the cured mold. A blown, squeezed, cured, mold having a resin content of 0.75% has a mold tensile strength equal to a blown, cured, mold with a resin content of 1.5%. The squeeze apparatus comprises a resilient spacer strip selectively provided peripherally along the horizontal surface of the pattern plate or the contour pre-form and spacer rods or spacer bars which are freely mounted through the contour pre-form so as to selectively fixedly space the blow plate from the pattern plate during the blowing operation and to subsequently permit squeezing or compression of the mold prior to the gassing sequence.

The molding machine apparatus is provided with an operator's control console (not shown) providing a selection of manual, single, automatic or repeat automatic controls. Appropriate electrical, pneumatic and hydraulic lines (not shown) are provided to carry out the desired operation and sequencing of the molding apparatus. Although not shown, an individual catalyst gas system is provided with safety pressure relief valving and dual control cure and purge cycle timers.

While there are many automatic mold machines found in the prior known art, there are none which are specifically adapted for use with chemically bonded sands of the external catalyst type. Representative of the prior art U.S. Pats. are Wood, No. 2,349,219, Sutter, No. 2,867,017, Ellms, No. 3,089,205, Miller, No. 3,205,542, Hunter, No. 3,406,738, Hunter, No. 3,520,348, Lund, No. 3,528,481, Lund, No. 3,556,195, Masi, No. 3,695,338 and Ikuo, No. 3,674,129.

It is thus seen that a highly utilitarian automatic molding machine apparatus is provided which is specifically adapted to produce molds by the use of chemically bonded sands of the external catalyst type. The use of chemically bonded sand in mold making is well known in the art, however, until the present invention, such use has not been made in connection with high production automatic molding machines due to the molding material cost and the lack of a machine that could produce controlled low sand volume molds.

The use of the chemically bonded sand process in conjunction with the described apparatus offers finished molds having excellent dimensional stability with minimium sand volume at a high production rate.

The automatic mold apparatus is designated to produce a horizontally parted honeycomb mold or a vertically parted controlled contoured mold. The honeycomb mold design gives mold strength, facilitates internal cure, and provides for minimum sand requirement, minimum catalyst, and for a minimum cure and purge cycle. It also provides the ability to change mold size and high production while affording dimensional stability. The mold shape further provides for ease of handling and clamping.

The controlled contoured mold also provides for a minimum sand requirement. It permits controlled mold section thicknesses, minimum catalyst to develop mold tensile strength, minimum cure and purge cycle, simultaneous production of cope and drag sections, high production and dimensional stability.

The mold machine apparatus of the instant invention provides for a hydraulically operated clamp table whereas most of the prior art machines utilize air pressure for actuation thereof. The use of a hydraulic system provides for greater clamping pressure and is more precise in its controlling action. The use of the hydraulic system thus affords greater control and flexibility than existing air control systems.

The provision of a venturi-type blow chamber having dual blow valves provides for a greater distribution of low pressure air in the sand filled magazine. This provides a uniformity of sand extrusion to form a more dense mold. Undesirable turbulence of air and sand is thus avoided. This eliminates channeling of sand in the magazine.

The blow head consists of an integral air chamber which in effect is a reservoir which avoids starvation of the air supply during the operating cycle. The known prior art structures utilize separate air tanks and piping to provide the operating air supply.

The carriage mounted sand magazine permits loading of the magazine at one station and blowing of the sand from the magazine, into the mold, at an adjacent station. The carriage shuttles the sand magazine to its fill position and simultaneously shuttles the gassing manifold into position over the blown mold and the mold is gassed. In this manner, the gas catalyst and bulk sand are kept separate so that the chemically bonded sand does not set up in the sand magazine. In such chemical reactive situations, time of introduction of the gas catalyst to the bulk sand mass is critical and has heretofore mitigated against full automation of mold production by use of chemically bonded sands.

The provision of an enclosed pattern and stripper stool and the exhaust manifold in association therewith greatly increases operator safety by expeditiously removing the toxic gases formed in the reaction of the gas catalyst with the chemically bonded sand. The toxic gases are exhausted to a gas scrubber treatment unit (not shown). The use of the exhaust manifold system reduces the overall tooling costs because the need for expensive sealing precautions are minimized.

The provision of a stripper pin actuation plate with two separate hydraulic actuators provides good pattern stripper pin control hitherto not found in the devices of the prior art.

The honeycomb molding machine apparatus of the instant invention is further unique because of the hydraulically actuated completed mold receiver and associated clamp assembly. The shuttle car transfer incorporates a trunnion type rollover assembly which includes a hydraulic rotary actuator (180°).

It is thus seen that an automatic method and apparatus for producing molds using chemically bonded sands is provided which can be readily adapted to existing tooling with a minimum of modification to the existing tooling. Expeditious pattern changes are accomplished through a cylinder actuated latching device.

It is therefore an object of this invention to provide a method and apparatus for producing molds using chemically bonded sand which is fully automated and capable of high production.

Another object of this invention is to provide an automatic method and apparatus for producing molds using chemically bonded sand which can be readily adapted for use with existing tooling with a minimum of modification.

Yet another object of this invention is to provide an automatic method and apparatus for producing molds using chemically bonded sand which keeps the gas catalyst separate from the bulk sand and automatically introduces the gas catalyst to the chemically bonded sand at the proper critical time during the molding cycle.

Still another object of this invention is to provide an automatic method and apparatus for producing molds using chemically bonded sand which uses hydraulic means to actuate the various machine components to achieve precise control and sequencing during the production cycle.

Another object of this invention is to provide a method and apparatus for squeezing or compressing the sand mold after blowing but prior to the gassing sequencing.

Other objects and advantages found in the construction of the invention will be apparent from a consideration of the following specification in connection with the appended claims and the accompanying drawings.

IN THE DRAWINGS

FIG. 12 is a partial front view of the automatic mold machine showing the stripper pin plate clamp assembly in association therewith.

FIG. 13 is a front elevational view of the stripper pin plate clamp assembly.

SPECIFIC DESCRIPTION

Figure 1:
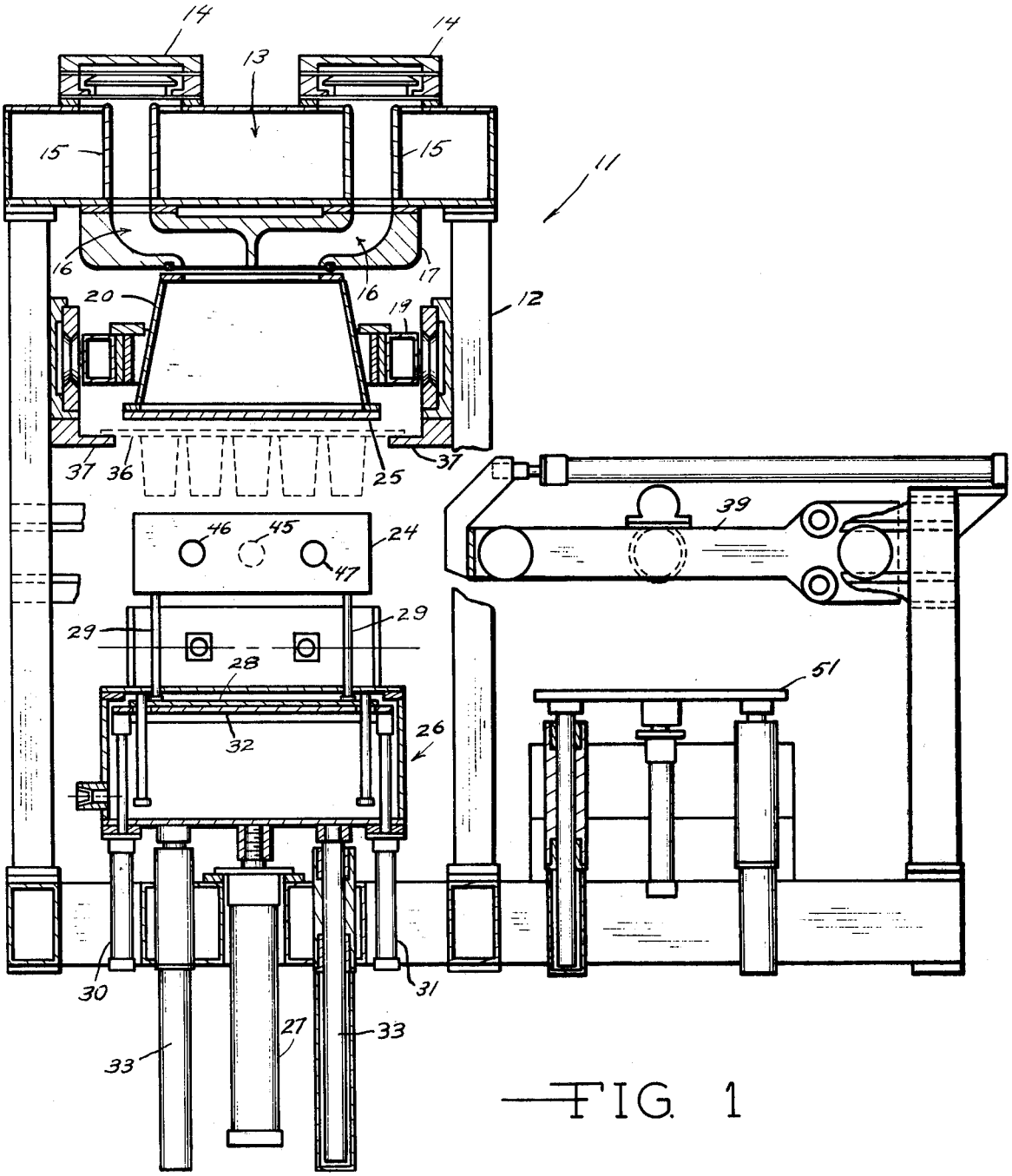
FIG. 1 is a front elevational view of the automatic mold machine showing the mold pick-off and rollover assembly in association therewith.
Figure 2:
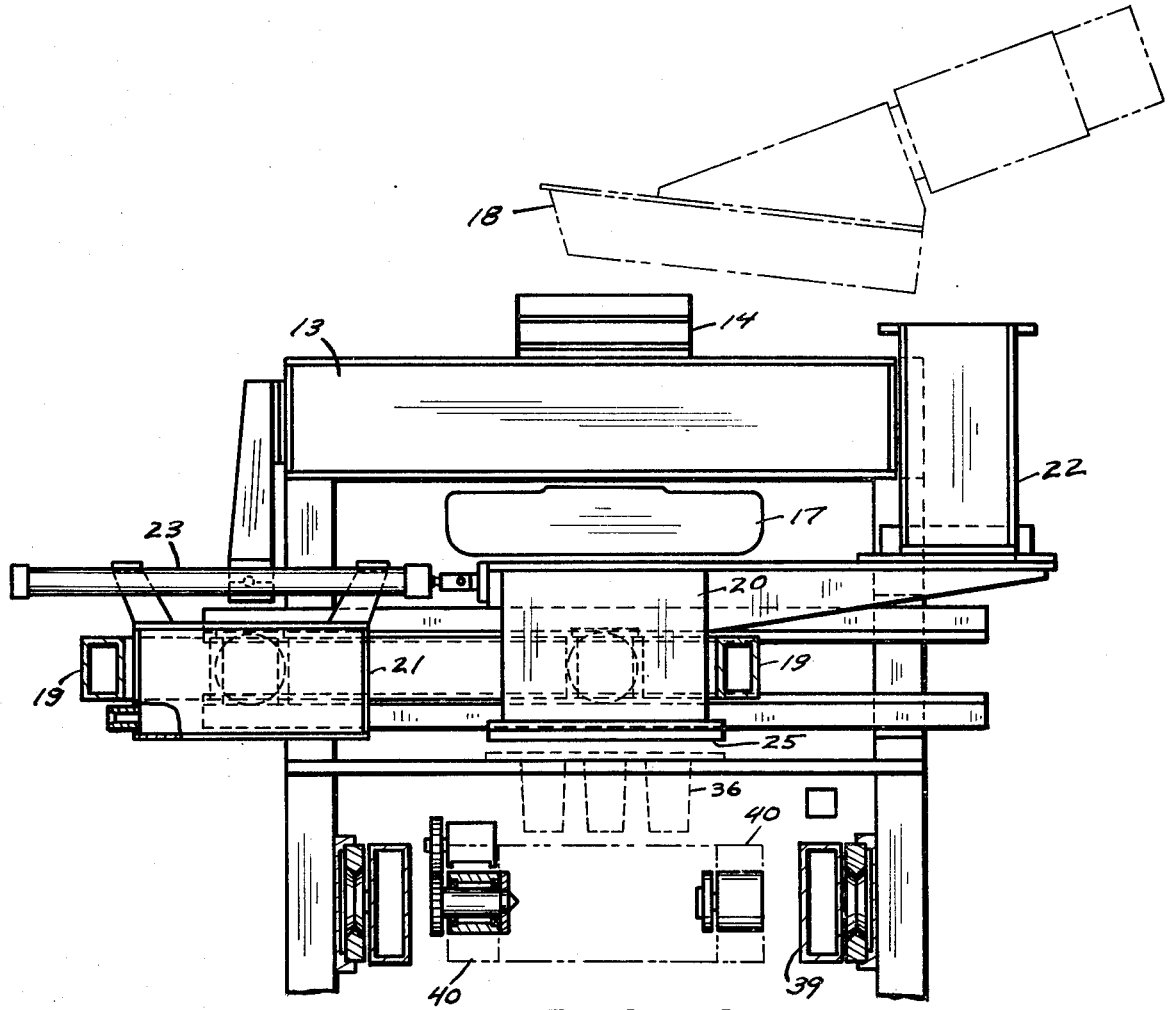
FIG. 2 is a partial side elevational view of the automatic mold machine assembly.
Figure 4:
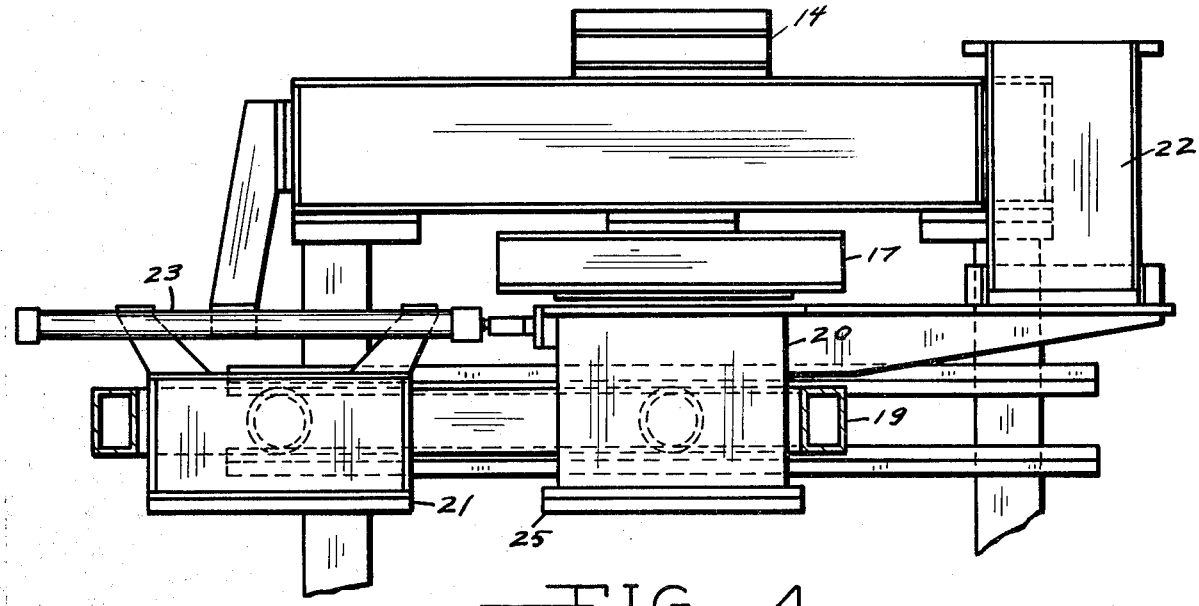
FIG. 4 is a partial side elevational view of the automatic mold machine showing the sand magazine carriage transfer means.

As shown in the drawings, the automatic molding machine 11 consists of a machine frame 12 having an integral air chamber 13 across the top thereof. Dual blow valves 14 are provided at the top of the air chamber 13. The dual blow valves are connected to conveyor tubes 15 which pass through the air chamber 13 and connect with passages 16 provided in the venturi blow head 17. A bulk sand hopper 18 is provided above the automatic mold machine so as to provide bulk sand to the mold machine as required. A traversely positioned carriage assembly 19 is provided below the venturi blow head 17 and extends rearwardly therefrom. A sand magazine 20 is mounted on the carriage assembly 19 so as to be in selective register below the venturi blow head 17. A gas catalyst manifold head 21 is also mounted on the carriage 19 and is positioned adjacent the sand magazine 20 opposite the bulk sand loading chute 22. The carriage assembly 19 is actuated by hydraulic actuator means 23 to shuttle the sand magazine 20 from its blow position beneath the venturi blow head 17 to its sand loading position beneath the sand loading chute 22. This movement simultaneously positions the gas catalyst manifold 21 to its gas position above the blown sand mold assembly 24.

The sand magazine 20 is provided with openings in the top thereof so as to selectively receive bulk sand from the sand hopper chute 22 or controlled low pressure air from the dual blow valves 14 via the venturi blow head 17. A blow head plate 25 is mounted below the sand magazine 20 so as to selectively direct bulk sand into the mold cavity positioned therebelow. A vertically movable pattern clamp table assembly 26 is positioned on the base of the machine 11 and is actuated by a hydraulic cylinder assembly 27.

Clamp table assembly 26 is comprised of a stripper pin stool which also acts as a noxious gas exhaust manifold and enclosure for stripper pin plate 28, stripper pin 29 and stripper pin actuator plate 32. This clamp table assembly 26 is guided vertically by guide rods 33. Two separate vertically extendable stripper pin hydraulic actuators 30 and 31, are attached to a stripper pin actuator plate 32. The stripper pin actuator plate 32 is provided with a cylinder actuated clamp device 34 to rapidly connect the stripper pin plate 28 to the stripper pin actuator plate 32. (see FIGS. 12 and 13). The clamp device 34 consists of a hydraulically actuated pivotally mounted locking arm 35 which selectively clamps the stripper pin plate 28 to the actuator plate 32.

The pattern clamp table assembly 26 is adapted to be selectively movable upwardly so as to clamp the pattern tooling stack into operative engagement with the blow head plate 25 which is mounted to the sand magazine 20.

Upon completion of the mold blowing and exhausting operation, the pattern clamp table 26 is adapted to move downwardly to an intermediate stop position. Carriage 19 containing sand magazine 20 and gassing manifold 21 shuttles to position the gassing manifold 21 directly over clamp table 26 containing the tooling stack and the blown mold. Pattern clamp table 26 moves upwardly to clamp and squeeze blown mold section against gassing manifold 21. After mold has been squeezed, gassing and purging cycles occur on a timed basis. Table 26 then moves downwardly so that the (minimizer or contour) blow head 36 is picked up by carrier pins 37 and is stripped from the cured mold. The stripper pins 29 are then actuated to strip the cured mold section 24 or 38 from the pattern. The shuttle car assembly 39 is indexed into mold machine 11 to receive the cured mold section 24 or 38.

Figure 5:
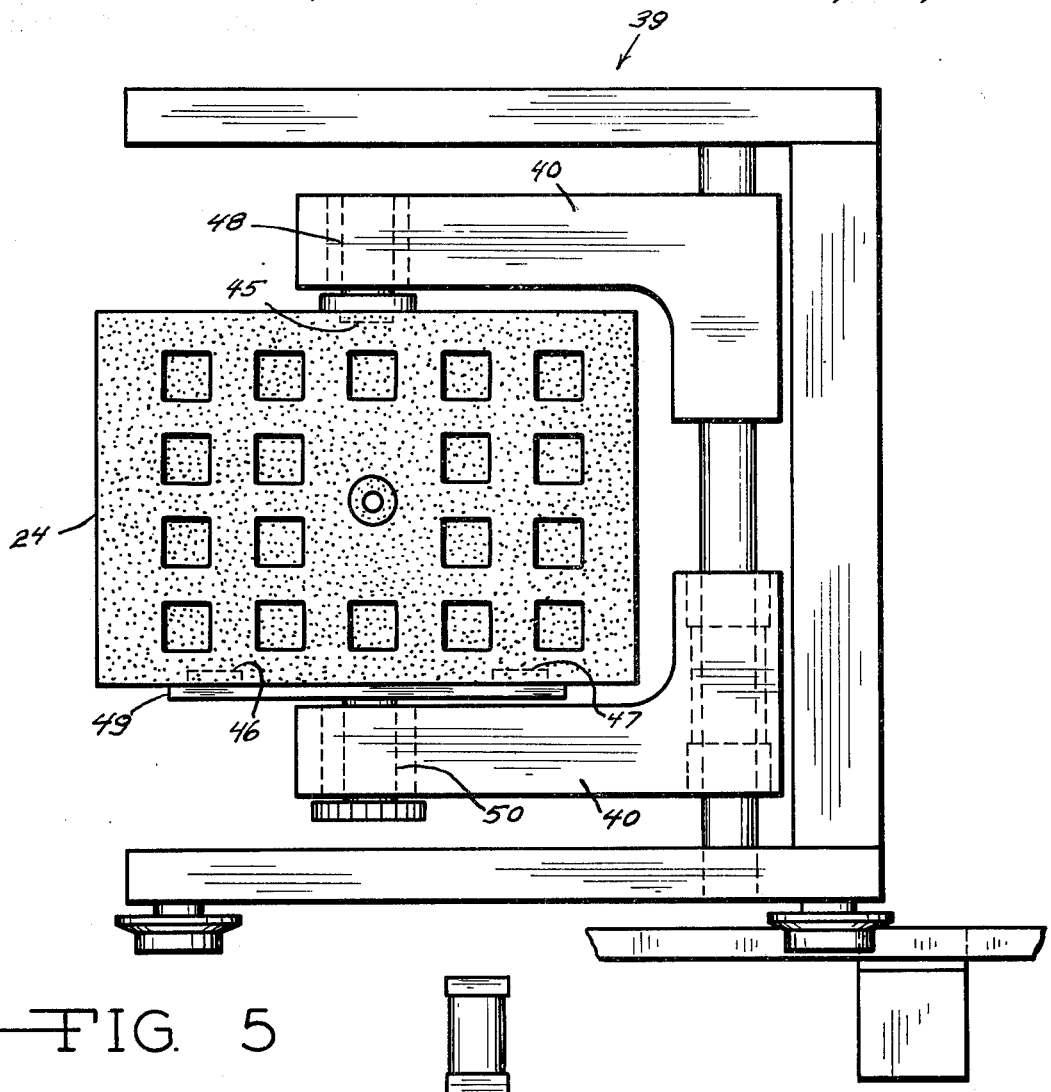
FIG. 5 is a top view of the mold rollover assembly.
Figure 7:
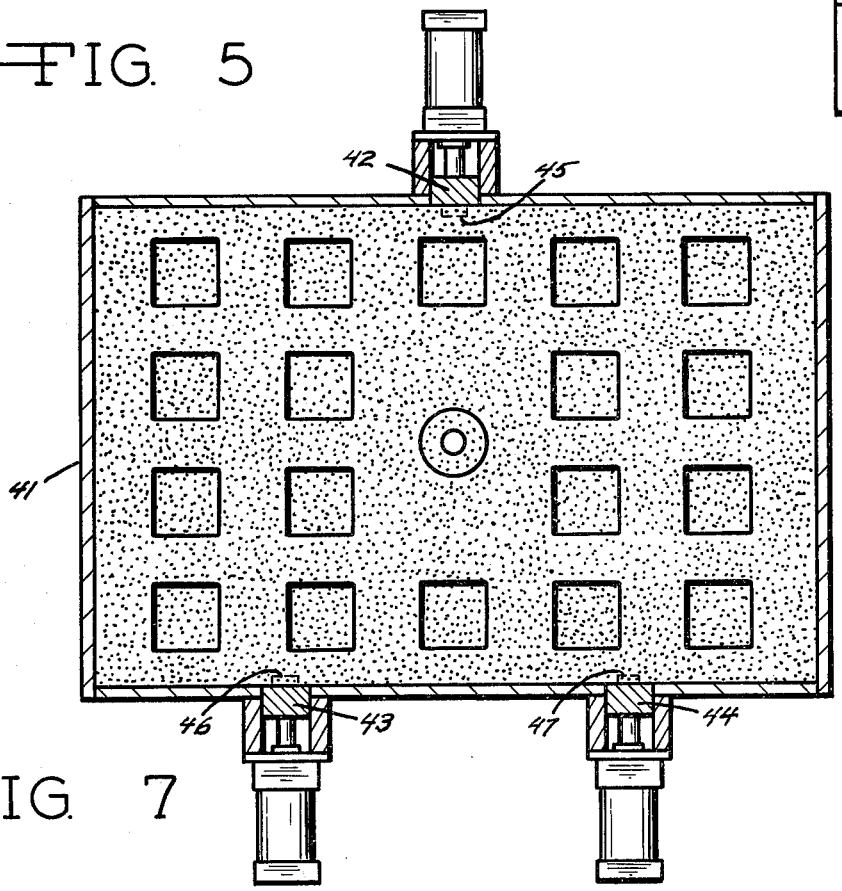
FIG. 7 is a sectional view of the honeycomb mold assembly.
Figure 6:
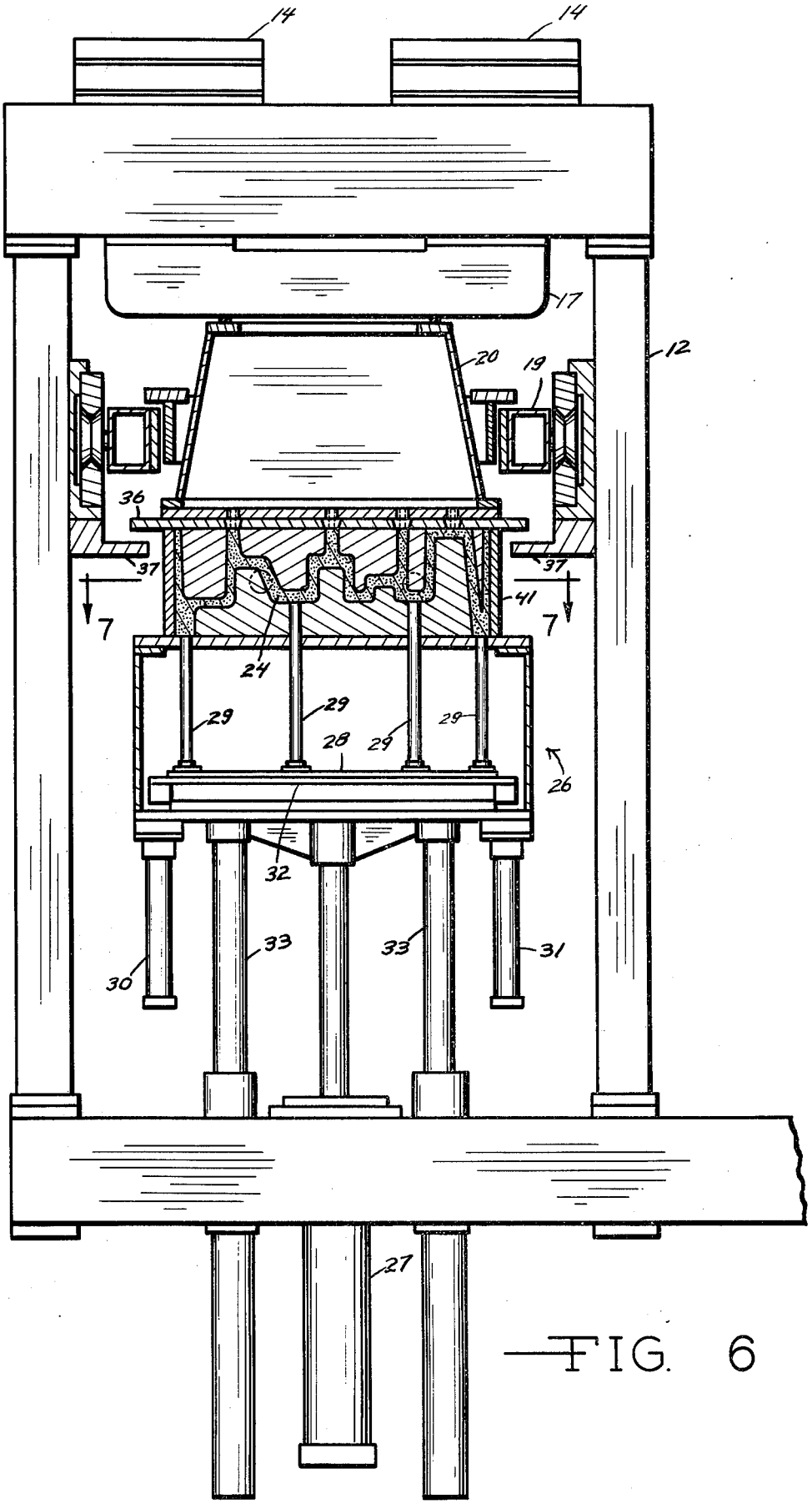
FIG. 6 is a front elevational view of the automatic mold machine showing the stripper pin assembly.
Figure 8:
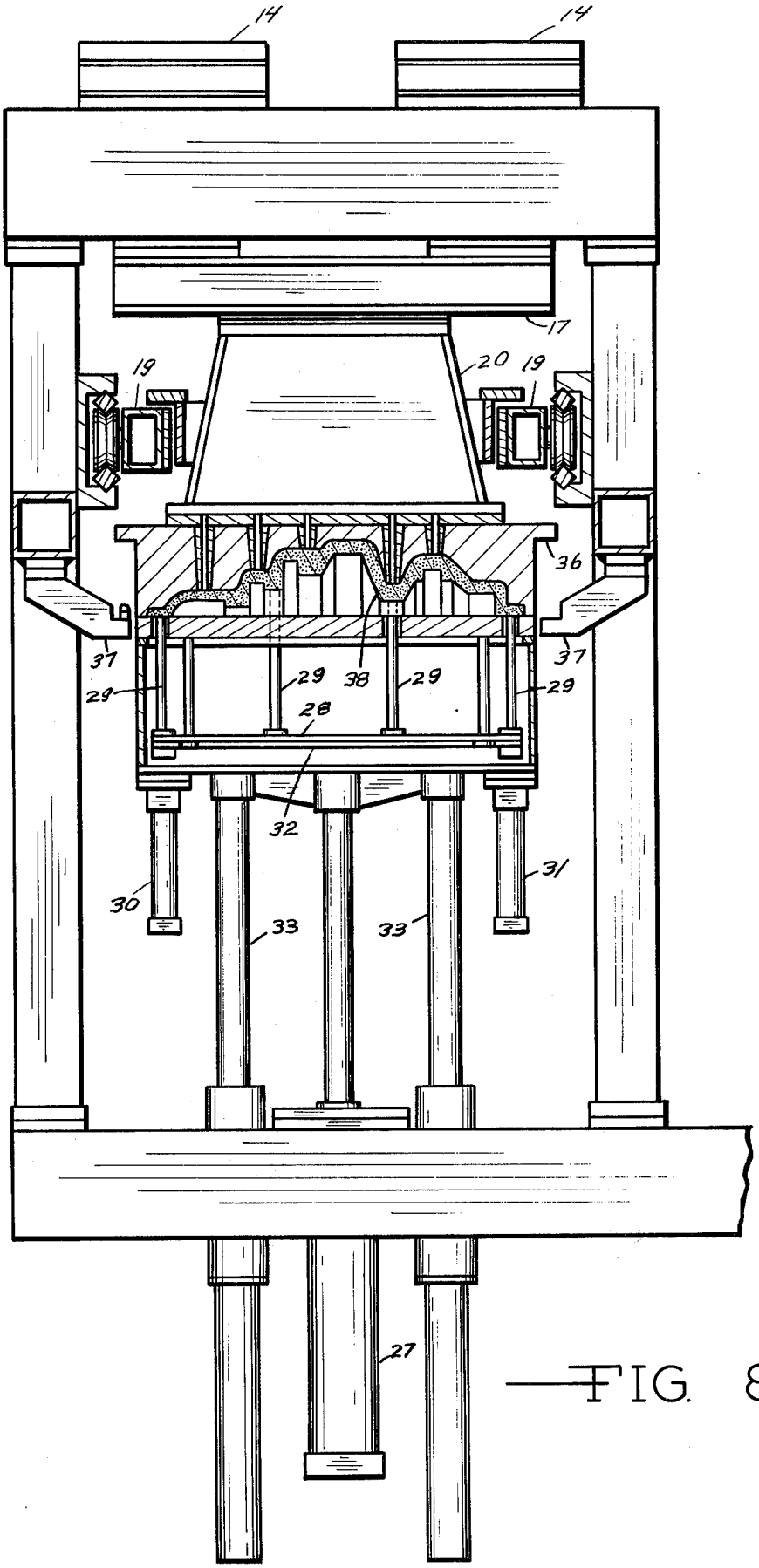
FIG. 8 is a front elevational view of the automatic mold apparatus showing a controlled contour (vertically parted) mold element used therewith.

When used with a honeycomb (horizontally parted) mold section 24, the shuttle car 39 is provided with a yoke assembly 40 which engages the mold section 24 as shown in FIG. 5. The flask 41 is provided with hydraulically actuated pocket forming elements 42, 43 and 44 which are selectively extendable into the mold cavity so as to form corresponding sockets 45, 46 and 47 in the walls of the sand mold section 24 formed within the flask 41. Upon completion of the molding operation, the pocket forming elements 42, 43 and 44 are retracted and the sand mold section 24 is removed from the flask 41 as described herein.

The yoke assembly 40 is provided with an idler shaft 48 on one arm thereof which engages socket 45 provided in the sand mold section 24. A rollover drive bar 49 is provided on the opposite arm of the yoke 40 which is adapted to engage the corresponding sockets 46 and 47 provided in the sand mold section 24. The rollover drive bar 49 is selectively rotated by a hydraulic gear driven privot shaft 50.

The shuttle car 39 is then indexed to the rollover position directly over the mold ejection table 51. The rollover drive bar 49 is actuated to roll or invert the mold section 24 for 180°. The mold ejection table 51 is moved upwardly to contact the bottom of the rolled mold section 24. The mold section 24 is then released from the yoke member and the mold ejection table 51 is moved downwardly to a mold unload position. The cured mold section is then ejected by suitable pusher means (not shown).

Figure 3:
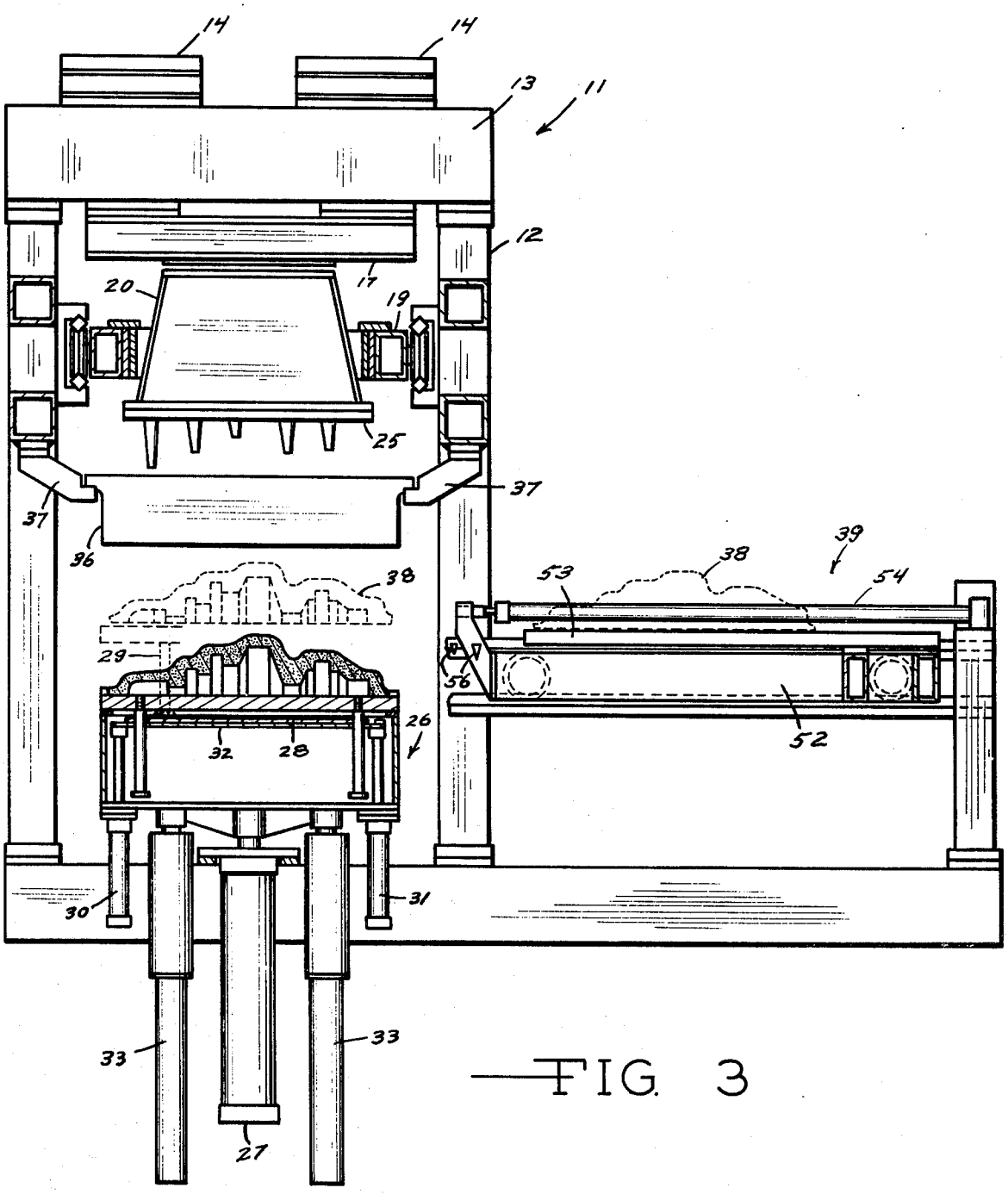
FIG. 3 is a front elevational view of the automatic mold machine showing the pattern clamp table in its open lowered position.
Figure 9:
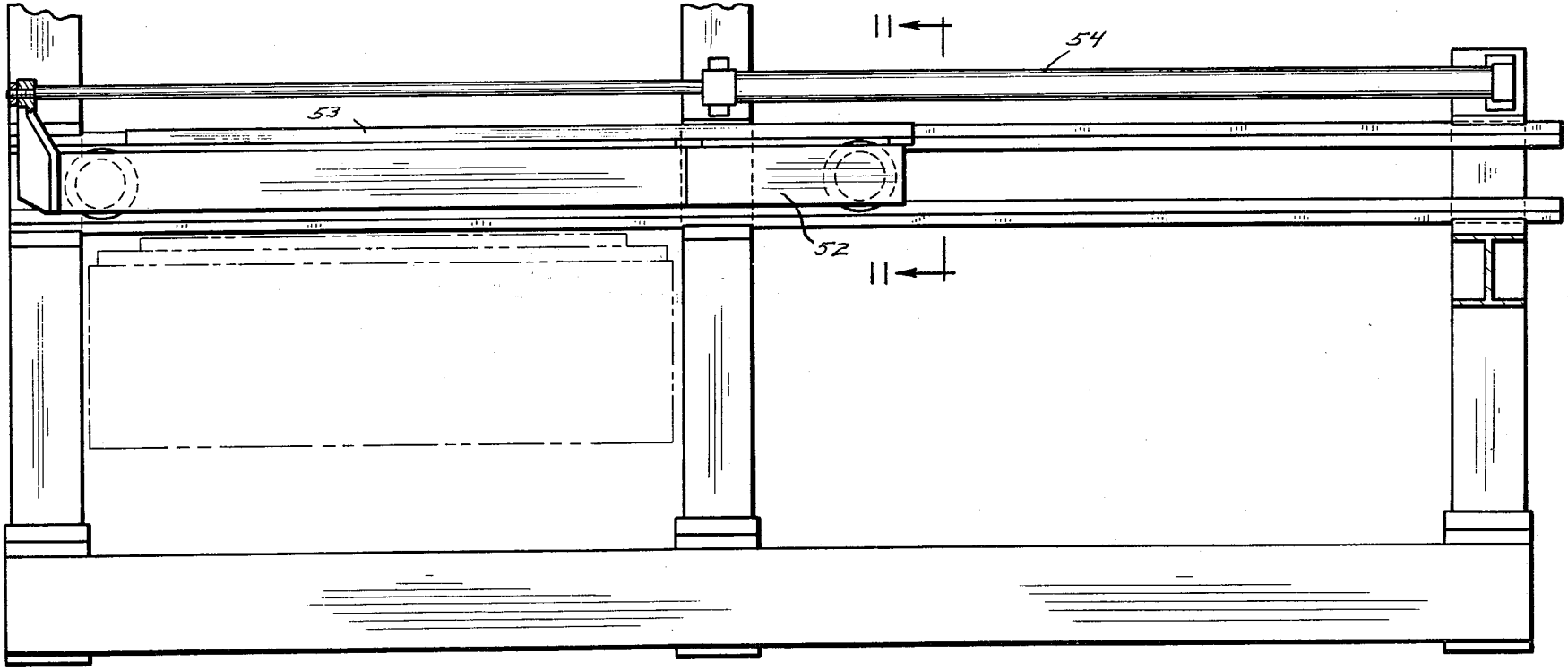
FIG. 9 is a side elevational view of the mold pick-up and shuttle sled assembly.
Figure 10:
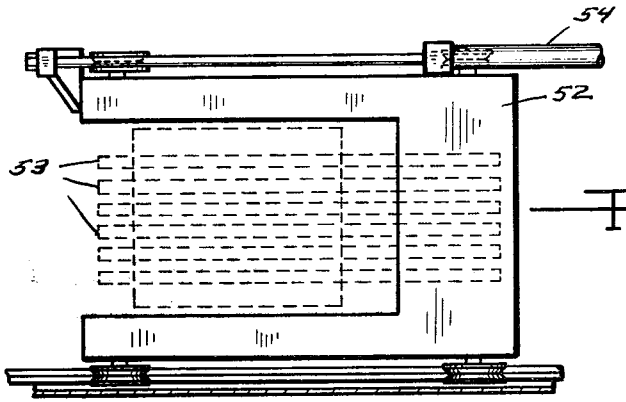
FIG. 10 is a top schematic view of the mold pick-up and shuttle sled assembly and showing the mold pick-up finger elements in phanton-line.

When used with a controlled contour sand mold 38 as shown in FIGS. 3, 9 and 10, the shuttle car 52 is provided with a plurality of horizontally and vertically adjustable pick-up fingers 53. The fingers 53 engage the bottom surface of the sand mold 38 when the shuttle car 52 is indexed into the mold machine 11 to receive the cured mold section 38. After picking-up the cured mold section 38, the shuttle car 52 is indexed outwardly to the mold unload position. The shuttle car 52 is actuated by the hydraulic actuating cylinder 54. In either case, the shuttle cars 39 or 52 are provided with wheels which are mounted in trackage 55 so as to permit movement of the shuttle cars therealong.

As shown in FIG. 3, the shuttle cars 39 and 52 are provided with automatically sequenced blow-off and release agent spray nozzles 56 which blow-off and spray the pattern, flask and blow heads as the shuttle cars 39 and 52 pass thereacross.

Figure 14:
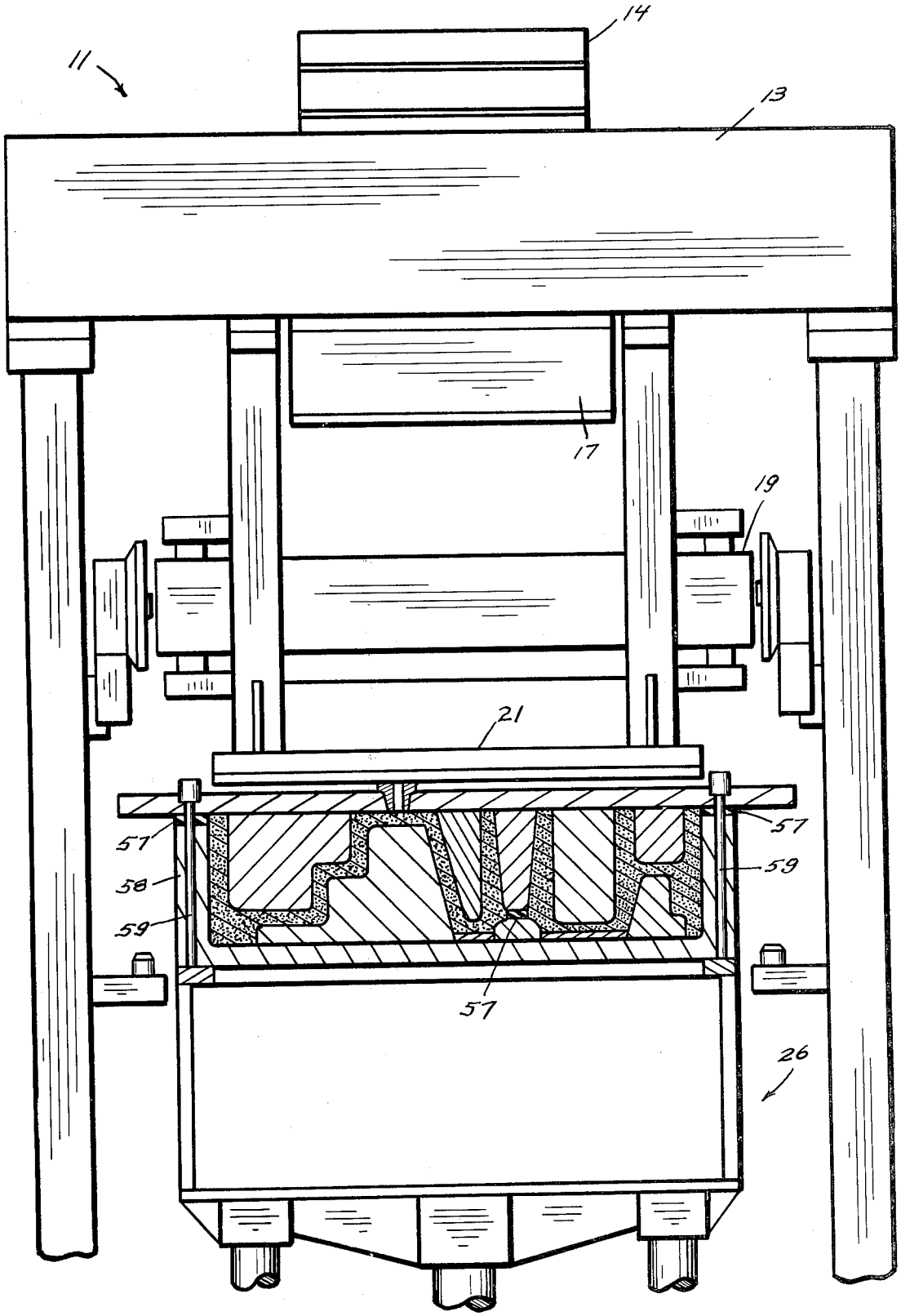
FIG. 14 is a partial front view of an embodiment of the automatic mold machine showing the squeeze spacer strip with squeeze spacer rods in their free floating position.
Figure 15:
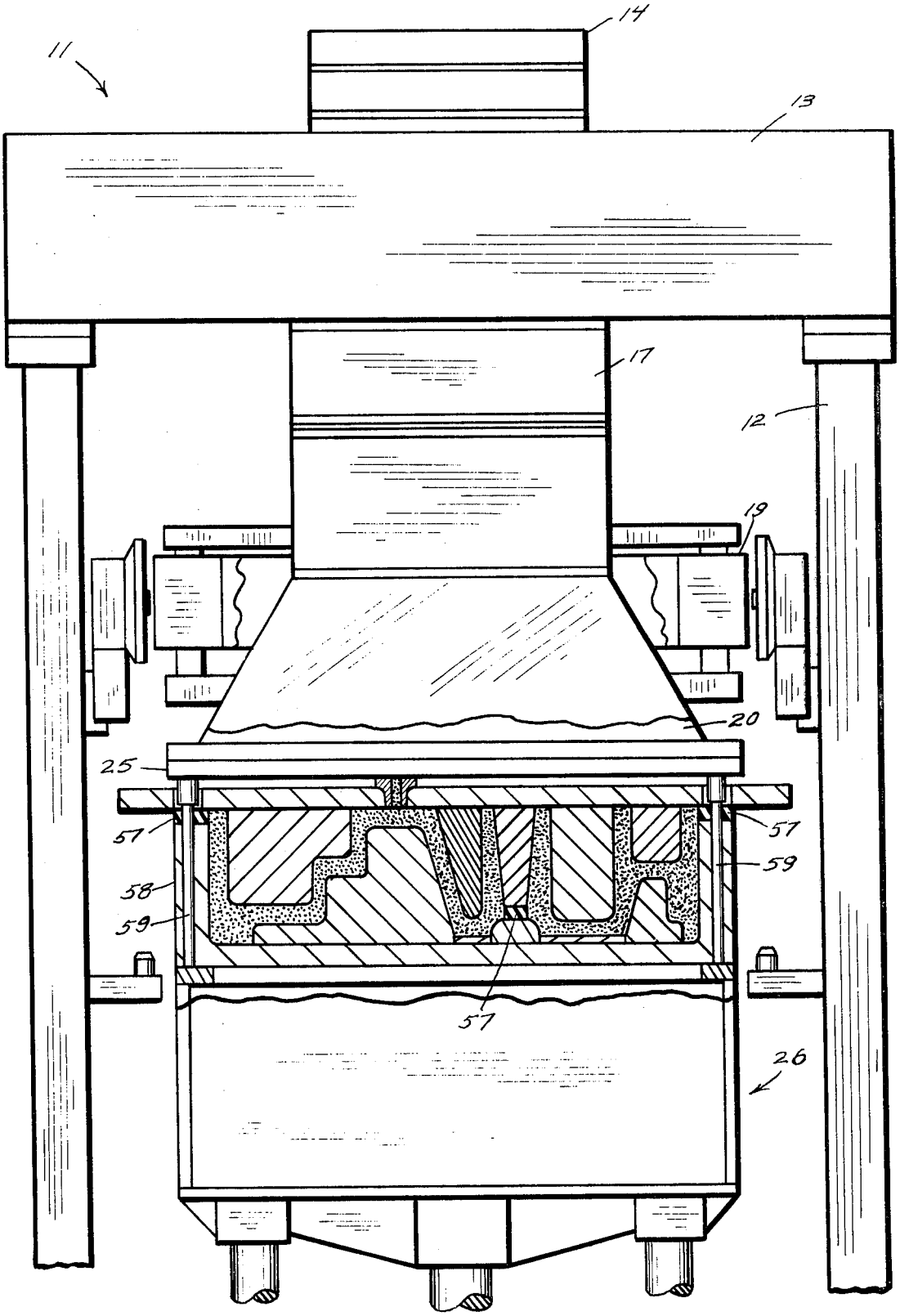
FIG. 15 is a partial front view of an embodiment of the automatic mold machine showing the spacer rods in spacing contact with the blow plate and pattern plate.

Another important embodiment of the automatic mold machine method and apparatus is shown in FIGS. 14 and 15. It has been shown that the conventional method of blowing resin coated sand molds or cores and achieving certain tensile strengths, has been significantly increased by squeezing the mold or core after blowing and prior to the gassing sequence. The incorporation of the squeeze or compression step in the mold production cycle has reduced the amount of resin utilized in the resin-sand mixture while maintaining comparable levels of tensile strength in the resultant molds. This has resulted in important cost savings.

Additional savings result because the reduction of resin content indicates a lesser amount of catalyst gas, i.e., less gassing time from an operational and productive consideration. Further, the reduction of resin content reduces the smoke pollution, increases the speed of resin burnoff and hence enhances the sand reclamation process. The resultant lesser resin content reduces production of gas burnoff during the pouring and solidification stages of the molten metal and hence, a decrease of casting defects in the finished castings.

As shown in FIG. 15, the squeeze or compression step is made possible by use of a resilient compression spacer strip 57 attached to the horizontal surface of the pattern plate or to the flask member 58. Spacer rods or spacer bars 59 are freely mounted so as to engage the blow plate member 25 and maintain it at a fixed distance from the pattern plate during the blowing operation. This will allow the blowing cycle to occur without squeezing or compression of the resilient spacer element 57.

As shown in FIG. 14, the spacer rods or spacer bars 59 do not contact the gassing manifold 21 and hence the blown mold or core will be clamped thereagainst so as to squeeze or compress the resilient spacer 57 so as to squeeze, compress or compact the mold prior to the gassing sequence.

OPERATION

The operation of the automatic molding machine follows a carefully sequenced molding cycle. The operator initiates the first cycle at a control console (not shown). The clamp table assembly 26 moves the pattern tooling stack upwardly to engage the blow plate 35 and sand magazine 20. The hydraulic pump which powers the clamp table assembly shifts to high pressure to facilitate clamping of the pattern tooling stack to the blow plate 35 during the blow operation. At this point, in the squeeze or compression embodiment, the spacer rods or spacer bars 59 maintain the blow plate 35 at a fixed distance from the pattern plate so as to avoid compression during the blowing operation. The sand is then blown into the mold around the pattern profile and the sand minimizer blow head or controlled contour blow head in a timed sequence step. Upon completion of the blow operation the magazine automatically exhausts excess air therefrom.

The hydraulic pump shifts to low pressure and the clamp table moves down with the blown mold section to an intermediate stop position at selectively variable distance from the blow plate 25. The sand magazine carriage shuttles to position the gassing manifold in register with the blown mold 24 and the sand magazine 20 to the refill position where it is refilled with bulk sand.

The clamp table moves up to engage the blown mold section 24 with the gassing manifold. The hydraulic pump shifts to high pressure to facilitate clamping of the assembly during the gassing and purge cycle. At this point, the spacer rods or spacer bars 59 are not engaged and compacting or squeezing of the blown mold occurs. The gassing cycle then takes place in a timed sequence step. Upon completion of the gassing cycle, the purge cycle occurs in a timed sequence step. The pump shifts to low pressure and the clamp table starts downwardly at slow speed. As shown in FIG. 1, the blow head assembly 36 is picked up by carrier fingers 37 and is stripped from the cured mold section 24 as the table continues to move down.

The magazine carriage 19 shuttles to reposition the filled sand magazine 20 in the ready position above the clamp table and the gassing manifold in the idle position. During foregoing movement of sand magazine carriage, the clamp table has continued downwardly and is now in full down position. (on the honeycomb mold machine the mold push-off detent or pocket formers are now retracted back into the walls of the flask)

The stripper pins 29 are now acutated and the cured mold section 24 is stripped from the flask and pattern.

Figure 11:
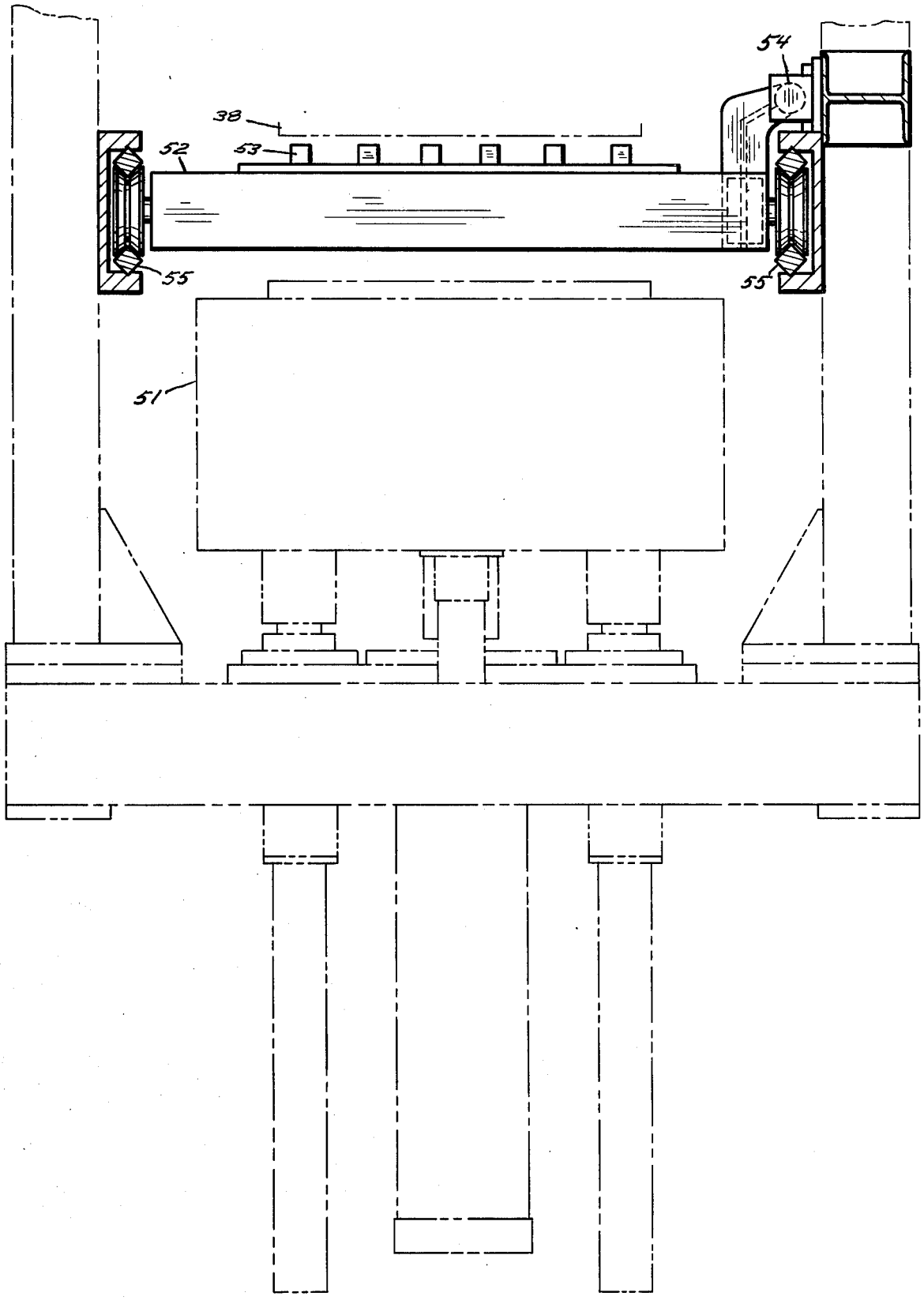
FIG. 11 is an end view of the mold pick-up and shuttle sled assembly.

It should be noted that the foregoing procedure is followed whether honeycomb mold 24 or contoured mold 38 is being utilized in the molding machine 11. Further, the mold section receiving shuttle car 39 is utilized to remove the cured honeycomb mold 24 and the shuttle 52 (see FIGS. 9, 10 and 11) is utilized to remove the cured contour mold 38.

The mold section receiving shuttle car 39 moves into place and clamps the cured mold section 24. The stripper pins 29 retract to their normal position and the mold section car 39 shuttles to the rollover station. At this point, if the machine is on the automatic repeat cycle, the next molding cycle begins as described above. The trunnion rollover 40 then rolls the mold section 180°.

The mold ejection table 51 then moves up to contact the bottom of the rolled mold section 24. The mold section 24 is unclamped and the ejection table 51 moves down to the unload position. The mold section is then ejected from the mold machine to a finishing and closing area.

It is thus seen that a highly utilitarian and fully automatic molding method and machine are provided for producing molds using chemically bonded sands.

Various other modifications of the invention may be made without departing from the principle thereof. Each of the modifications is to be considered as included in the hereinafter appended claims, unless these claims by their language expressly provide otherwise.

We claim:

1. An automatic mold machine for producing molds using chemically bonded sands comprising:

a mold machine frame;

blow head means provided at the uppermost portion of said frame;

bulk sand delivery means in association with said frame;

carriage means provided on said frame, said carriage means adapted to selectively shuttle between and below said blow head means and said bulk sand delivery means;

a sand magazine positioned on said carriage means, said sand magazine adapted for selectively positioning below said blow head means and said bulk sand delivery means upon selective corresponding movement of said carriage means;

a gas catalyst manifold positioned on said carriage means adjacent said sand magazine, said gas catalyst manifold adapted to be in an idle position when said sand magazine is positioned below said blow head means, said gas catalyst manifold movable to a gassing position below said blow head means upon corresponding movement of said sand magazine to its fill position beneath said bulk sand delivery means;

a pattern clamp table provided in spaced-apart register below said blow head means, said pattern clamp table having a pattern tooling stack positioned thereon, said pattern clamp table adapted to selectively clamp said pattern tooling stack against said sand magazine and said blow head means during the mold blow operation and to selectively clamp said pattern tooling stack against said gas catalyst manifold during a mold squeeze and gas catalyst operation;

mold squeeze compression assembly means in association with said pattern tooling stack and said clamp table so as to permit selectively maintaining said blow head means and said clamp table in non-compressive relationship during the blow operation and permitting compression of the blown sand mold after the blow operation and before the gassing operation through a compressive relationship between said clamp table and said gas catalyst manifold; and mold ejection assembly means provided in association with said frame, said mold ejection assembly means adapted to remove the cured sand mold from the automatic mold machine.

2. In the automatic mold machine of claim 1 wherein the blow head means includes a venturi-type blow head having dual blow valves and an integral air chamber.

3. In the automatic mold machine of claim 1 wherein the mold ejection means include a shuttle car movable transversely in relation to said mold machine frame, said shuttle car provided with a yoke mold pick up and roll over assembly thereon to selectively remove the cured sand mold from the mold machine.

4. In the automatic mold machine of claim 1 wherein the mold ejection means include a shuttle car movable transversely in relation to said mold machine frame, said shuttle car provided with elongate pick up fingers thereon adapted to selectively remove the cured sand mold from the mold machine.

5. In the automatic mold machine of claim 1 wherein the compression assembly means include spacer rods freely mounted in association with said pattern tooling stack and said clamp table, said spacer rods adapted to selectively maintain said blow head means and said clamp table in fixed spaced-apart positions during the mold blow operation, said spacer rods adapted to selectively permit free engagement of said clamp table, said pattern tooling stack and said gas catalyst manifold so as to permit compression of the blown sand mold and a resilient spacer strip provided in association with said pattern tooling stack so as to facilitate compression of the blown sand mold.

* * * * *